United States Patent [19]

Rueggeberg

[11] 4,275,301

[45] Jun. 23, 1981

[54] CORONA DISCHARGE DEVICE

[75] Inventor: Werner Rueggeberg, Lancaster, Pa.

[73] Assignee: Armstrong Cork Company, Lancaster, Pa.

[21] Appl. No.: 128,539

[22] Filed: Mar. 10, 1980

[51] Int. Cl.[3] ..... H01T 19/04

[52] U.S. Cl. ..... 250/326; 250/324; 250/309; 204/164

[58] Field of Search ..... 250/324–326, 250/306, 309; 427/13, 39; 204/1.5, 164; 264/25; 118/621

[56] References Cited

U.S. PATENT DOCUMENTS

| | | | |
|---|---|---|---|
| 2,458,320 | 1/1949 | Unschuld . | |
| 3,308,045 | 3/1967 | Sullivan | 250/325 |
| 3,396,308 | 8/1968 | Whitmore | 250/326 |
| 3,484,363 | 12/1969 | Williams . | |
| 3,654,108 | 4/1972 | Smith | 204/164 |
| 3,794,839 | 2/1974 | Hayne | 250/324 |
| 4,051,044 | 9/1977 | Sorensen | 250/325 |
| 4,153,560 | 5/1979 | Dinter | 204/164 |
| 4,159,425 | 6/1979 | Lowther | 250/533 |

*Primary Examiner*—Harold A. Dixon

[57] ABSTRACT

A corona discharge device is provided, the device providing for the formation of a corona discharge characteristic of a selected gas or gas mixture to be ionized by use of a housing which is separated into an upper and lower plenum chamber by a perforated plate. The lower plenum chamber contains at least one corona discharge electrode and has inwardly tapered wall means for directing the gas or gas mixture into the active corona region. The device is particularly suitable for deglossing wear resistant coatings on floor covering materials.

4 Claims, 2 Drawing Figures

CORONA DISCHARGE DEVICE

Figure 1:
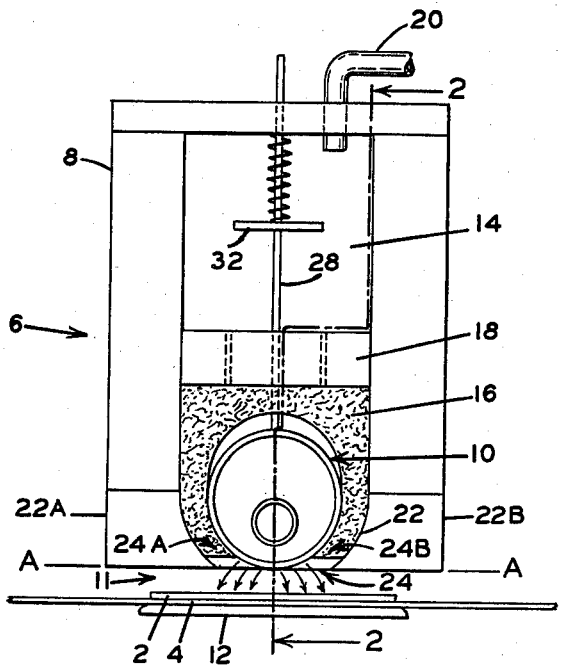

This invention relates to a corona discharge device.

In one of its more specific aspects, this invention relates to a corona discharge device which facilitates the formation of a corona discharge characteristic of a selected gas. The corona discharge device of this invention is particularly well suited for use to degloss coatings curable by either radiant energy or by a combined radiant energy and moisture cure.

The application of wear resistant coatings to floor covering materials is well known. Usually these coatings provide abrasion resistance and impart a high gloss appearance to the floor covering material. The abrasion resistance provided by these coatings is always a desirable property. However, the high gloss appearance is not desirable especially in high traffic areas. Accordingly, the floor covering industry is continually looking for new ways to control the gloss levels of these coatings.

Prior art methods of reducing gloss or flatting typically involve the employment of various particulate flatting agents in the coating compositions. The use of flatting agents has been generally unsatisfactory since their use results in deglossed coatings which exhibit a reduction in other physical properties. Another method known in the art is steam deglossing (see Ser. No. 922,308, filed July 6, 1978 now U.S. Pat. No. 4,197,344).

According to this invention, there is provided an apparatus for treating a material with a corona discharge characteristic of a selected gas or gas mixture which apparatus comprises:

(a) a housing;

(b) a perforated plate separating the housing into an upper plenum chamber and a lower plenum chamber, the lower plenum chamber having inwardly tapered wall means defining an opening in the housing at the bottom of the lower plenum chamber;

(c) an inlet means opening into the upper plenum chamber for supplying a gas or gas mixture into the upper plenum chamber whereby the gas passes from the upper plenum chamber through the perforated plate and is uniformly distributed into the lower plenum chamber wherein the tapered wall means directs the gas towards the opening at the bottom of the lower plenum chamber;

(d) a ground electrode means positioned parallel to the opening and spaced a distance apart from the housing; and, (e) at least one corona discharge electrode means positioned adjacent and parallel to the opening in the lower plenum chamber, dividing the opening into gas passageways around the corona discharge electrode means such that the gas flows perpendicular to the lengthwise direction of the electrode means and exits through the opening into the region existing below the corona discharge electrode means and above the ground electrode means where the gas or gas mixture is ionized forming a corona discharge characteristic of the gas introduced through the inlet means wherein a material to be treated is passed.

While the apparatus of this invention is suitable for corona treatment of any materials, it is particularly suitable for deglossing coatings curable by radiant energy or a combined radiant energy and moisture cure which coatings are superimposed on semi-rigid or rigid substrates.

Figure 2:
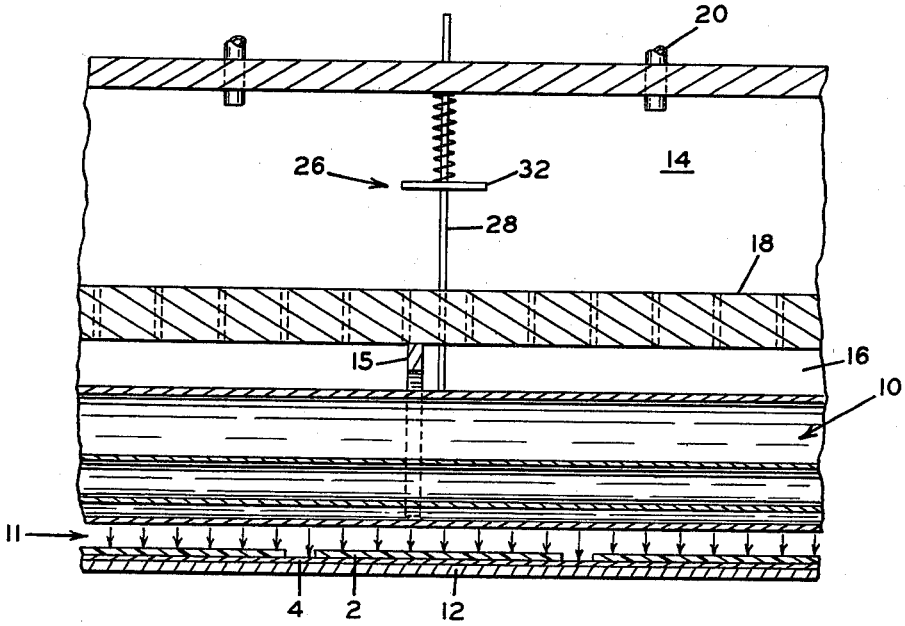

The apparatus of this invention will be more easily understood if explained in conjunction with the drawings in which:

FIG. 1 depicts a side view of the apparatus of this invention with a side wall of the housing removed; and, FIG. 2 depicts a front view in cross section alone line 2—2 of the apparatus of this invention.

Referring now to FIGS. 1 and 2, there is shown material to be treated 2, in this instance a vinyl floor tile coated with a radiant energy curable wear resistant coating, carried on means for moving 4 which can be any conventional non-conductive conveyor system.

Corona discharge device 6 is comprised of three principle parts, housing 8, corona discharge electrode means 10, and ground electrode means 12. Corona discharge region 11 exists in the gap formed between corona discharge electrode means 10 and ground electrode means 12.

Housing 8 can be of any suitable electrical insulation material, for example glass fiber reinforced silicone, Lexon, or the like, and is divided into upper plenum chamber 14 and lower plenum chamber 16 by perforated plate 18. Perforated plate 18 is also of a suitable electrical insulation material. As shown in the drawings, the perforations in the plate consist of two rows of holes. Alternatively, the perforations can be slots or any type and number of aperatures which serve to uniformly distribute gas from the upper plenum chamber to the lower plenum chamber.

Housing 8 is adapted in upper plenum chamber 14 with inlet means 20 for supplying a gas or gas mixture to be ionized from a gas source not shown.

As shown in the drawings, lower plenum chamber 16 has inwardly tapered wall means 22 which define an opening 24 in the housing at the bottom of the lower plenum chamber. Replaceable inwardly tapered wall shoes 22A and 22B terminate at opening 24 forming a plane containing the opening. As shown in the drawing, the plane exists along line AA. For efficient use of the corona, electrode means 10 has its lower surface in line with or slightly beneath the plane containing the opening.

Corona discharge electrode means 10 is positioned adjacent and parallel to opening 24 in the lower plenum chamber. Electrode means 10 is held in position by support means 15 positioned between the tapered walls means of the lower plenum chamber. Hanger 15 holds the electrode means in place and limits its downward motion.

Corona discharge electrode means 10 can be one or more of any suitable corona discharge electrodes and is preferably a liquid cooled, liquid-quartz buffered corona discharge electrode comprising an elongated electrode encased in a quartz tube of sufficient diameter to create a passageway between the electrode surface and the inside diameter of the quartz tube which facilitates good liquid dielectric/coolant flow through the passageway. Particularly suitable for use is the corona discharge electrode described in co-pending application Ser. No. 128,540 filed Mar. 10, 1980. Corona discharge electrode means 10 divides the lower plenum chamber into two or more gas passageways. As shown in FIG. 1, the single corona discharge electrode 10 divides the lower plenum chamber into two gas passageways, 24A and 24B, one between each tapered wall means and the electrode means.

Ground electrode 12 can be of any high conductive metal of suitable configuration and in this instance was an aluminum plate positioned parallel to and a spaced distance apart from opening 24. As shown in the drawing, the plate is located beneath the conveyor belt such that the side of the belt facing away from the corona passes over the plate.

Optionally, as shown in the drawing to avoid breaking the quartz tube encasing the electrode, corona discharge electrode means 10 is resiliently mounted in opening 24 by mounting means 26 comprised of insulating rod 28, spring 30 and spring retaining plate 32 which permits the corona discharge electrode means to move upwardly from below the plane of the opening to above the plane of an opening in the event an obstruction projects from the surface of the material being treated.

In the best mode for practicing this invention, the above described corona discharge device operates as follows.

As a flooring tile having an ultraviolet radiation curable coating to be deglossed on its surface passes through the active corona region 11, which exists in a gap of preferably from about 0.02 to about 0.25 inch between the bottom of the quartz tube and the surface to be treated, a gas or gas mixture, for example, nitrogen, argon, argon and carbon dioxide etc. is supplied to the upper plenum chamber of the housing through the inlet opening. The gas collects in the upper plenum chamber and then diffuses, from the upper plenum chamber, through the perforated plate and is uniformly distributed into the lower plenum chamber. The tapered wall shoes of lower plenum chamber serve to direct the gas towards the opening at the bottom of the lower plenum chamber. The gas passes around and perpendicular to the lengthwise direction of the corona discharge electrode at a flow rate of from about 10 to about 35 liters per minute per electrode and exits the opening through the passageways between each tapered wall shoe and the outer surface of the electrode means. The gas exiting through the passageways forces away all contaminating gases, e.g. oxygen, air, if the coating being treated is one that's cure is oxygen inhibited and forms an active corona region characteristic of the inlet gas in the gap. The corona discharge electrode is connected to a high-frequency, high-voltage electrical power supply and the gas in the active corona region is ionized forming a corona discharge characteristic of the plenum chamber gas which corona discharge treats the radiant energy curable coating on the tile as it is passed through the active corona region between the corona discharge electrode and the ground plate electrode. After corona discharge treatment, the coated tile is bulk cured by ultraviolet radiation and recovered as a deglossed floor tile.

It will be evident from the foregoing that various modifications can be made to this invention. Such, however, are considered to be within the scope of this invention.

What is claimed is:

1. An apparatus for treating a material with a corona discharge characteristic of a selected gas or gas mixture which apparatus comprises:

(a) a housing;

(b) a perforated plate separating the housing into an upper plenum chamber and a lower plenum chamber, the lower plenum chamber having inwardly tapered wall means defining an opening in the housing at the bottom of the lower plenum chamber;

(c) an inlet means opening into the upper plenum chamber for supplying a gas or gas mixture into the upper plenum chamber whereby the gas passes from the upper plenum chamber through the perforated plate and is uniformly distributed into the lower plenum chamber wherein the tapered wall means directs the gas towards the opening at the bottom of the lower plenum chamber;

(d) a ground electrode means positioned parallel to the opening and spaced a distance apart from the housing; and, (e) at least one corona discharge electrode means positioned adjacent and parallel the opening in the lower plenum chamber, dividing the opening into gas passageways around the corona discharge electrode means such that the gas flows perpendicular to the lengthwise direction of the electrode means and exits through the opening into the region existing below the corona discharge electrode means and above the ground electrode means where the gas or gas mixture is ionized forming a corona discharge characteristic of the gas introduced through the inlet means wherein a material to be treated is passed.

2. The apparatus of claim 1 in which said gas exits the passageways at a rate of from about 10 to about 35 liters per minute per electrode.

3. The apparatus of claim 1 in which said corona discharge electrode means has its lower surface in line with or slightly beneath the plane containing said opening.

4. The apparatus of claim 1 comprising a means for mounting said corona discharge electrode in the lower plenum chamber such that said electrode will move upwardly from below the plane of the opening to above the plane of the opening.

* * * * *